US007823294B2

(12) United States Patent
Contreras

(10) Patent No.: US 7,823,294 B2
(45) Date of Patent: Nov. 2, 2010

(54) FLAT COMPASS FOR MARKING LARGE ARCSAND CIRCLES

(76) Inventor: Amaury D. Contreras, 16479 Pine Forest St., Fontana, CA (US) 92336

( * ) Notice: Subject to any disclaimer, the term of this patent is extended or adjusted under 35 U.S.C. 154(b) by 211 days.

(21) Appl. No.: 12/167,866

(22) Filed: Jul. 3, 2008

(65) Prior Publication Data

US 2010/0000102 A1 Jan. 7, 2010

(51) Int. Cl.
*B43L 9/04* (2006.01)

(52) U.S. Cl. ..... 33/27.03

(58) Field of Classification Search ..... 33/27.03, 33/27.031, 27.032

See application file for complete search history.

(56) References Cited

U.S. PATENT DOCUMENTS

| | | | | | |
|---|---|---|---|---|---|
| 948,172 | A | * | 2/1910 | Ide | 33/27.03 |
| 983,830 | A | * | 2/1911 | Manz | 33/27.032 |
| 1,005,827 | A | | 10/1911 | Gombarts | |
| 1,282,020 | A | * | 10/1918 | Anderson | 33/27.03 |
| 1,572,237 | A | * | 2/1926 | Hunt | 33/27.03 |
| 2,419,752 | A | | 4/1947 | Zumbuhl | |
| 2,581,858 | A | * | 1/1952 | Butterworth et al. | 33/27.03 |
| 2,681,507 | A | | 6/1954 | Underwood | |
| 2,699,607 | A | * | 1/1955 | Woodward | 33/27.03 |
| 2,768,443 | A | * | 10/1956 | Chiaravalloti | 33/27.03 |
| 2,818,644 | A | | 1/1958 | Crawford | |
| 2,976,614 | A | * | 3/1961 | Matuszewski et al. | 33/27.03 |
| 3,430,347 | A | * | 3/1969 | Minniear | 33/27.03 |
| 4,334,360 | A | | 6/1982 | Burns et al. | |
| 4,616,418 | A | | 10/1986 | Wade, III | |
| 5,033,197 | A | | 7/1991 | Irvello | |
| 5,497,558 | A | * | 3/1996 | Wagner | 33/27.03 |
| 5,651,184 | A | | 7/1997 | Tutty | |
| D572,611 | S | * | 7/2008 | Contreras | D10/63 |
| D584,971 | S | * | 1/2009 | Contreras | D10/63 |
| 2003/0182811 | A1 | | 10/2003 | Hairapetian | |

* cited by examiner

*Primary Examiner*—Christopher W Fulton
(74) *Attorney, Agent, or Firm*—Kirk A. Buhler; Buhler & Associates

(57) ABSTRACT

An improvement in a compass that marks large radius arcs is disclosed. The compass is for marking on flat surfaces like the ground and walls where higher degree of accuracy for the radius or circle is desired. More particularly, the present flat compass allows a person to create a virtually unlimited radius arc using a center point and a rigid arm with a marking tip. The flat compass uses a rigid flat ruler with an embeddable anchor, such as a nail, on one end and a marking tip on the other that keeps the rigid arm essentially parallel with the marking surface as the surface is being marked. The marking tip is movable along the length of the rigid flat ruler. Multiple rulers can be connected to increase the size of the arc that will be drawn.

19 Claims, 4 Drawing Sheets

FLAT COMPASS FOR MARKING LARGE ARCSAND CIRCLES

This application claims the benefit of Design Patent Application 29/288,247 filed Jun. 6, 2007, now D572,611 issued Jul. 8, 2008, and Design Patent Application 29/307,106 filed Apr. 1, 2008 the entire contents of which is hereby expressly incorporated by reference herein.

STATEMENT REGARDING FEDERALLY SPONSERED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

DESCRIPTION

1. Field of the Invention

This invention relates to improvements in a flat compass for drawing large arcs and circles. More particularly, the present flat compass allows a person to create a virtually unlimited radius arc using a center point and a rigid arm with a marking tip. This is ideal for use in construction industry where precision of a pencil at the end of a string provides limited accuracy.

2. Background of the Invention

Most arc marking tools that are used for marking large arcs or circles use an anchor such as a nail and a pencil at the end of a string. These marking tools are crude and the accuracy of the mark can change as the string wraps around the anchor (nail) and the angle of the pencil changes as the user marks the arc. Several exemplary examples of marking large arcs involve using a flat ruler. The ruler usually has a nail at one end and a scribe or pencil at the other end. Two major problems exist with this type of marking system. The first problem is that the angle of the pencil or scribe can change since it is not supported in a flat parallel orientation with the surface being marked and the second problem is that the size of the arc is limited by the length of the ruler or stick. Exemplary examples of patents that have these problems are described herein.

U.S. Pat. No. 2,419,752 issued Apr. 29, 1947 to G. F. Zumbuhl and U.S. Pat. No. 4,616,418 issued Oct. 14, 1986 to Charles R. Wade II disclose beam compasses having a round or vertical beam with an anchor point at one end and a marking scribe tip or pencil at the other. While these patents describe a marking tool for marking arcs they do not maintain the marking tip perpendicular with the surface being marked and also are not expandable beyond the length or the beam.

U.S. Pat. No. 5,651,184 issued Jul. 29, 1997 to Larry Tutty discloses a Circumscribing Apparatus. This apparatus is constructed from square tubing and uses two guides and a single pencil. The guides slide along a fitting secured to a length of pipe where the pencil marks a finite distance from the guides. While this tool allows for marking, the tool does not mark arcs or circles. The tool is further limited to the length that the mark can be made from the guides. In addition the guides can score the pipe where it can weaken the integrity of the pipe.

U.S. Published application 2003/0182811 published Oct. 2, 2003 for Harouton Hairapetian discloses a Measuring Tape Radius Marking Tool. This measuring tool is securable onto a flexible tape measure. On the free end of a tape measure a nail is secured to the end of the tape measure through a slot. A pencil carrier tool is securable onto the flexible tape measure. While this patent discloses a marking system for marking arcs the use of a tape measure is flexible and the mark may not be consistent. There further is no provision for the pencil to remain in a perpendicular relationship with the surface being marked.

What is needed is am arc or circle marking compass where the marking beam is rigid and expandable. In addition the marking tip should be maintained in a perpendicular relationship with the surface being marked and the beam should be marked with both incremental inches and 0 to 12 inches every foot to minimize conversion. The proposed application satisfies these requirements with an expandable beam compass where the marking tip is maintained in a vertical orientation.

BRIEF SUMMARY OF THE INVENTION

It is an object of the flat compass to provide a compass for marking an arc where the radius of the arc is nearly infinite. Rulers are used in lengths of 12 inches or less to eight feet or more. These rulers can be connected together to make a longer or shorter length arc radius. The versatile length of the rulers allows for large and small arc radiuses to be made without requiring storage of a single long ruler.

It is an object of the flat compass to make the rulers with inch markings that do not repeat on one side of the ruler and in markings on the other side of the ruler that measure from zero to 12 inch markings. These markings allow a user to easily determine where to set the marking pencil without the need to make a conversion for inches to feet or vice versa.

It is another object of the flat compass is to use a wheel near the marking tip to maintain the marking tip in a vertical orientation. The vertical orientation ensures that the marking tip is always perpendicular to the surface being marked to create a more accurate mark. The wheel also maintains a three point plane such that the entire compass is planar throughout the marking process. The wheel can pivot or rise and lower to accommodate surface imperfections such as might be found on rock.

It is another object flat compass is to use a nail or similar anchor to fix one end of the compass. The insertion depth of the nail is set at the same distance from the beam as the marking tip and rolling wheel. All three points keep a planar relationship with the marking surface.

It is still another object of the flat compass is allow the type of marking tip to be variable based upon the surface being marked. In the case of drywall or wallboard, a pencil may be the preferred marked tip while when marking black stone or tile a scribe made of carbide would be preferred because it scores the surface.

Various objects, features, aspects, and advantages of the present invention will become more apparent from the following detailed description of preferred embodiments of the invention, along with the accompanying drawings in which like numerals represent like components.

DETAILED DESCRIPTION

Figure 1:
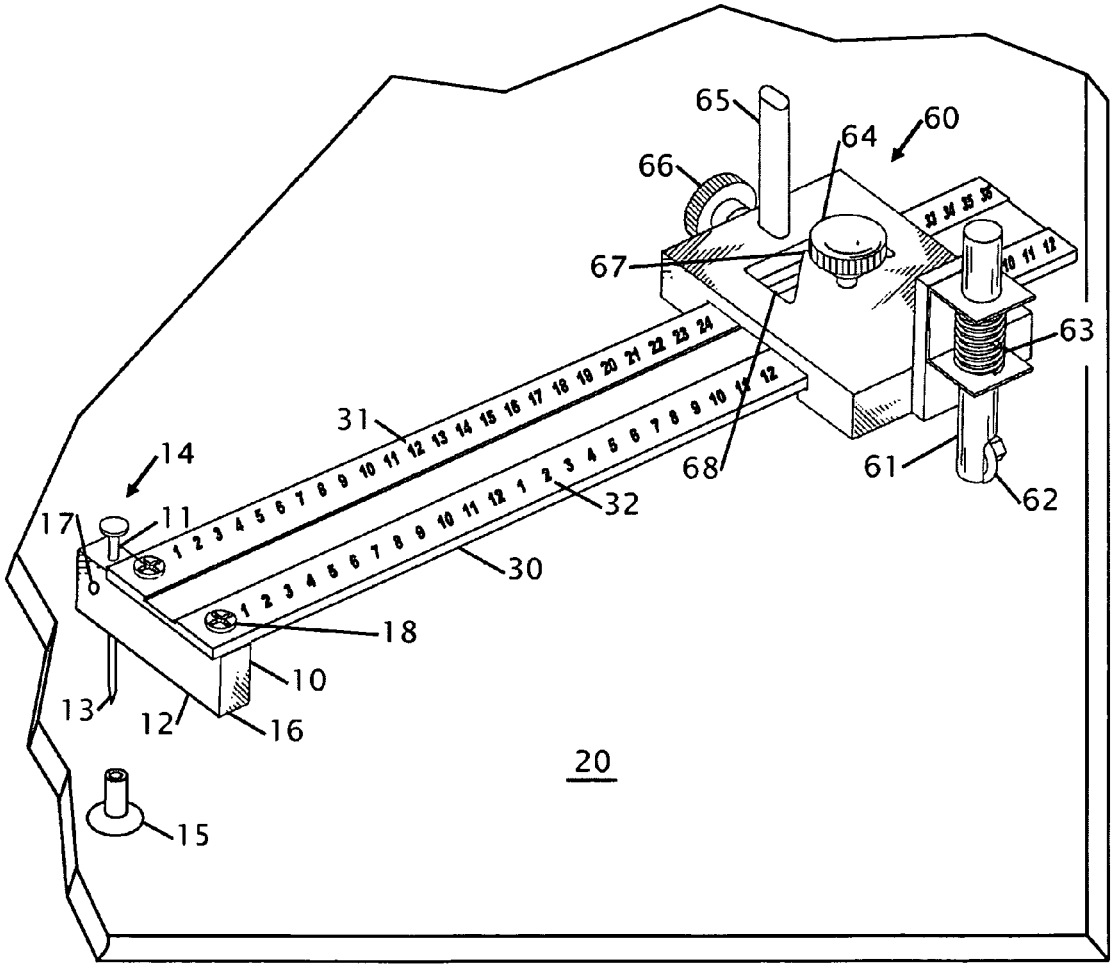
FIG. 1 shows an isometric view of a first embodiment of the flat compass.

FIG. 1 shows an isometric view of a first embodiment of the flat compass. The flat compass has an anchor 10 having an elongated shank 11 in combination with an enlarged flanged base 12 having a means for the function of limiting how far the shank is set into an essentially flat surface 20. The elongated shank 11 further has a tapered tip 13. The elongated shank 11 is from a nail 14. The shank 11 is limited to extend between 0.01 and 1.00 inches into the essentially flat surface 20 while this length of extension is broad it allows the elongated shank to extend into a variety of surfaces. In one contemplated embodiment a suction cup 15 can be placed onto the end of the elongated shank 13 for securing the flat compass for marking glass or other material where the elongated shank may not penetrate or is penetration is undesirable. Retaining screws 18 hold the anchor components onto a beam 30.

At an engagement length of 2 inches the elongated shank can penetrate and is rigidly secured into a semi soft material such as Styrofoam. The elongated shank 11 extends essentially perpendicular to the flat surface 20 of the beam 30. The enlarged flange 12 is a block 16 that both secures the elongated shank 11 to the essentially elongated beam 30 and elevates the elongated shank 11. The shank 11 is retained in the anchor 10 to prevent the shank from being removed from the anchor. The securing mechanism is with various diameters of the shank within the anchor, or with a set screw 17 that engages on recesses of the shank 11 to allow the elongated shank 11 to be driven into an essentially flat surface 20 and removed from an essentially flat surface. Loosening or removal of the setscrew 17 will allow the nail 14 to be easily replaced or straightened as required. In most used the nail 14 will be driven into wood, drywall cement, brick or concrete.

A beam connects the anchor sub assembly 10 to a head sub assembly 40. The beam is an essentially flat member or beam with numeric markings, as shown and described in FIG. 4. The markings correspond to a known length or distance measurement system. In the preferred embodiment the markings on the essentially flat beam are inch increments. It is contemplated that the beam has different markings on opposing top sides of the beam. One marking 32 would have inch markings repeat every 12 inches. The opposing side 31 of the essentially flat beam 30 has incrementally increasing inch increments and the opposing side 32 of the essentially flat beam has markings that repeat every 12 inches. The opposing top surfaces could have the same or different markings. In another contemplated embodiment the markings on the essentially flat beam are in metric distance increments.

Figure 5:
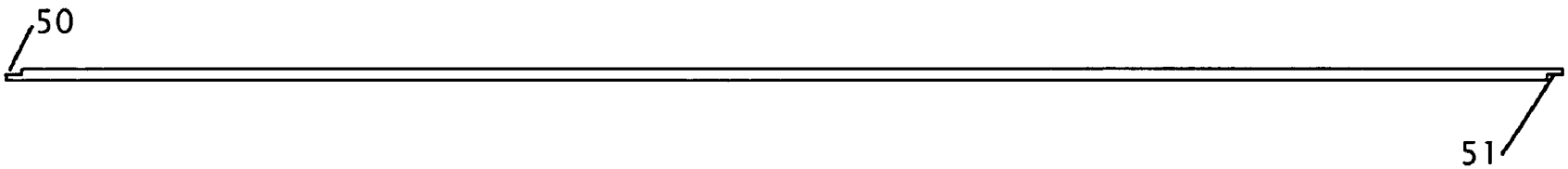
FIG. 5 shows a side view of the beam showing the ability to join multiple beams.

The essentially flat beam is configured with a step50, as shown in FIG. 5 that provides a means for engaging a second, or subsequent essentially, flat beams to the beam to increase the length of the beam to draw larger arcs. Each second, or subsequent, essentially flat beams have mating notches 50 and 51 on opposing ends of the beams.

The elongated shank 11 is located at a zero location 21 with the numeric marking. The head 60 is adjustable securable on the essentially flat beam 30 wherein the head 60 has both a marking means 65 and a tracking means that is a vertical shank61 whereby the tracking means functions for maintaining the marking means in an essentially perpendicular relationship of the marking means 65 with the essentially flat surface 20.

The head 60 further includes an indicating means, such as a pointer 67 inside a window 68 to identify the dimension of the arc that will be marked with the marking means 65. The tracking means is a rotatable wheel 62. The rotatable wheel 62 is spring 63 loaded. The rotatable wheel 62 is also self-tracking. The rotatable wheel 62 is adjustable for height between a contact surface of the rotatable wheel and the essentially flat beam 30. The marking means 65 is a pencil, pen, marker, cutter or scribe. The marking means 65 is adjustable for height between a marking tip and the essentially flat beam. The head 60 allows the tracking means and the marking means to be independently or dependently adjustable for their height between a contact surface 20 and the essentially flat beam 30. Knob 64 locks the head in position on the beam 30. Knob 66 locks the marking means 65 onto the head. In this figure the marking means 65 is a carpenters pencil but other types of marking pencils, markers, pens or scribes are contemplated.

Figure 2:
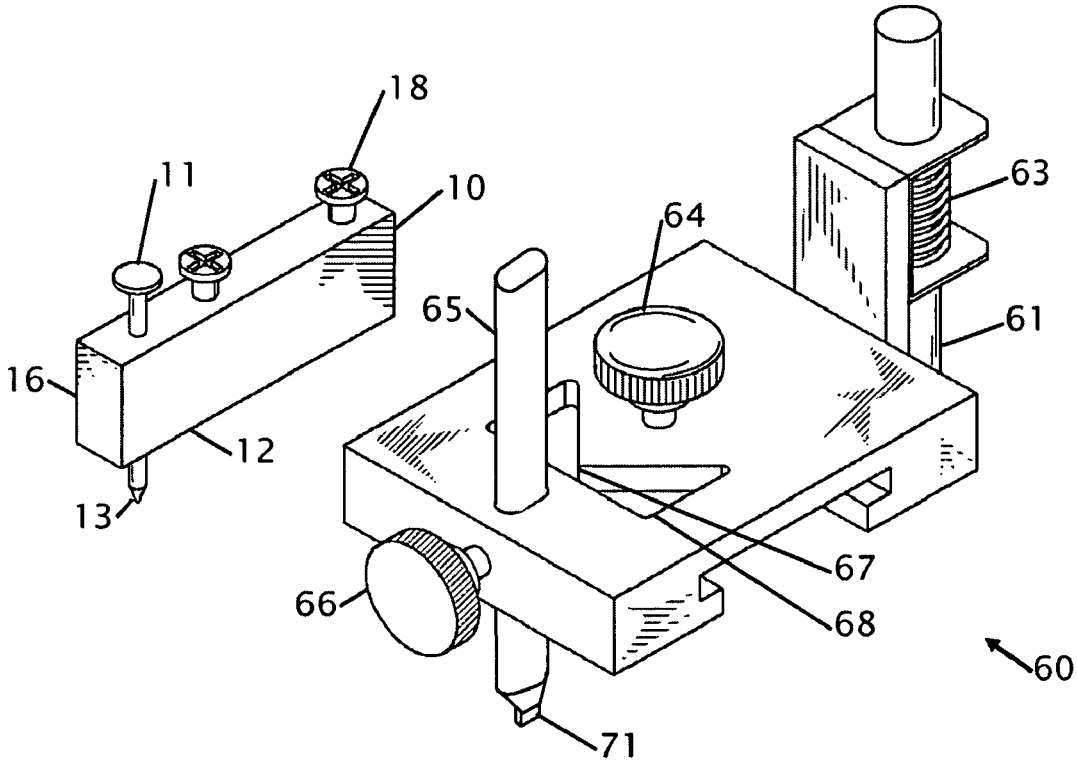
FIG. 2 shows an isometric view of the same embodiment from FIG. 1 without the beam.
Figure 3:
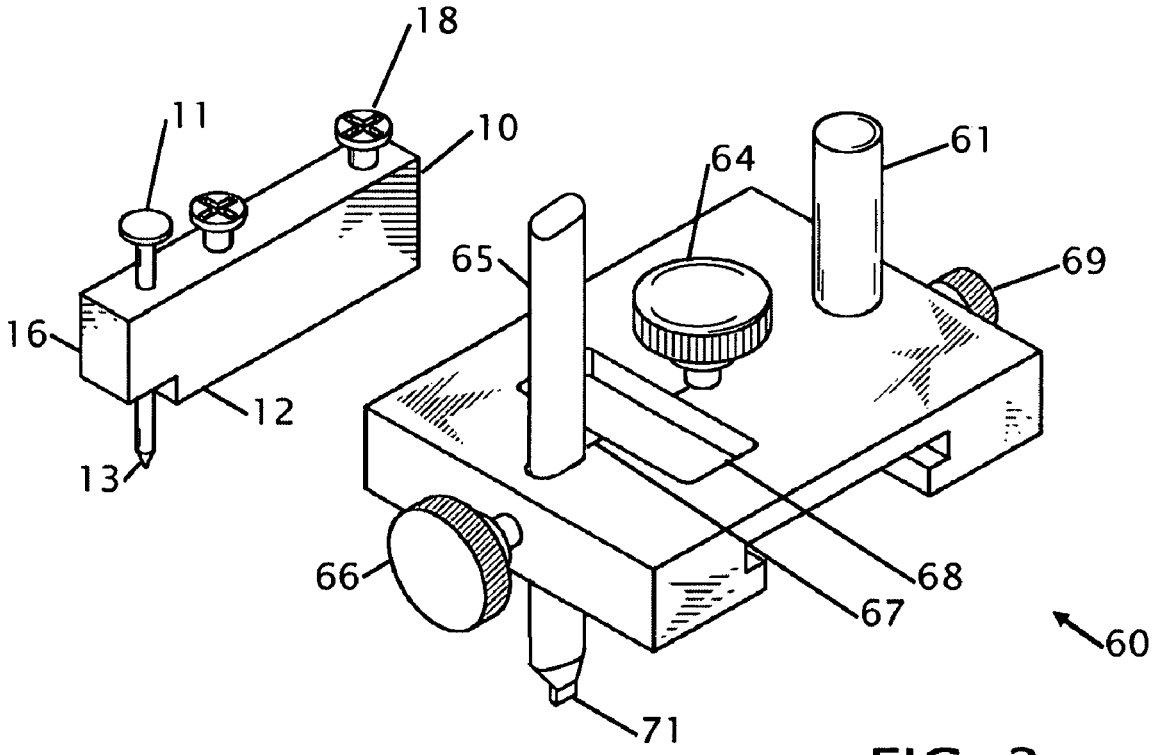
FIG. 3 shows an isometric view of a second embodiment of the flat compass without the beam.

FIG. 2 shows an isometric view of the same embodiment from FIG. 1 without the beam and FIG. 3 shows an isometric view of a second embodiment of the flat compass without the beam. These figures show the opening in the side of the head 60 where the beam would slide through to locate the head 60 on the beam (not shown). The anchor 10 is shown with the two retaining screws 18 that secure the beam onto the anchor 10. The top of the elongated shank 10 and the tapered tip of the elongated shank 11 or nail (14) is visible extending through the anchor 10. The tip 13 exists in a linear relationship with the marking tip 71 of the marking means 65. The anchor 10 has an enlarged flange base 12 made from a block of material 16. While the anchor is shown as a rectangular block of material other shapes are contemplated that will perform equivalently. In FIG. 2 the vertical shank 61 extends from a separate block of material whereas in FIG. 3 the vertical shank 61 extends through the head block. The bottom of the shank has a wheel (Not shown) that maintains the plane of the anchor in the same plane as the end of the marking tip 71 and the wheel 62 that is shown in FIG. 1.

Referring back to FIG. 2 and 3, the position lock 64 is shown on the top of the head 60. A window 68 has a mark pointer 67 or other similar identifying means to identify the radius of the arc or circle that is being drawn. Knob 66 secures the marking means 65 at a height where the marking tip is the same as the anchor to maintain the beam in a planar relationship with the surface that is being marked. Knob 69 provides a height adjustment for the tracking wheel.

Figure 4:
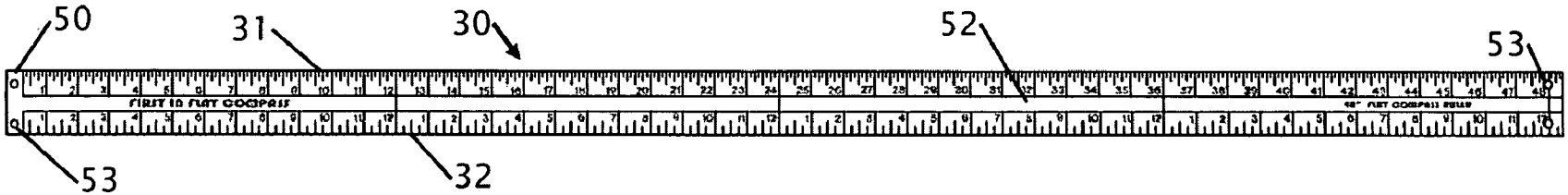
FIG. 4 shows a top view of the beam with the markings.
Figure 6:
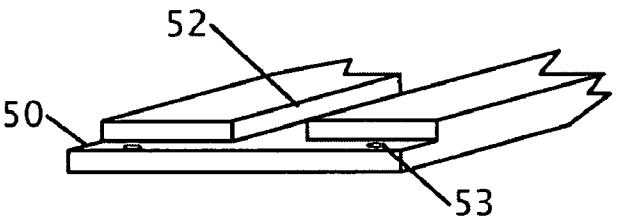
FIG. 6 shows a front view of the beam.

FIGS. 4, 5 and 6 show top, side and front view (respectively) of the beam with the markings. The beam 30 is shown as a 48 inch long beam. While a 48 inch long beam is shown shorter or longer lengths are contemplated. The 48 inch length is the preferred embodiment because the length is manageable and provides for circles up to eight feet in diameter without extensions. From FIG. 5 notches 50 and 51 are most visible. These notches are complimentary and allow additional lengths of beams to be secured using the holes 53 that are used to secure the anchor (not shown). A groove 52 extends down the length of the beam where the head (not shown) would track. From the top view in FIG. 4 one side of the beam 30 has incremental inch markings 31 and the opposing side of the same surface has inch markings that repeat from 1 to 12. The different markings on each side of the beam eliminate the need for conversion between inches and feet/inches.

Thus, specific embodiments of a flat compass have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A flat compass for drawing large arcs comprising:

an anchor having an elongated shank in combination with an enlarged flange having a means for the function of limiting how far the shank is set into an essentially flat surface;

an elongated essentially flat beam secured on one elongated end to said anchor such that said elongated shank extends essentially perpendicular to the flat surface of said beam;

said elongated essentially flat beam is configured to accept additional elongated essentially flat beam sections;

said essentially flat beam has numeric marking that correspond to a known length or distance measurement system;

said elongated shank is located at a zero location with said numeric marking, and a head that is adjustable securable on said essentially flat beam wherein said head has both a height adjustable marking means and a separate height adjustable tracking means that is spring loaded whereby said tracking means functions for maintaining said marking means in an essentially perpendicular relationship of said marking means with said essentially flat surface.

2. The flat compass according to claim 1 wherein said elongated shank further has a tapered tip.

3. The flat compass according to claim 1 wherein said elongated shank is a nail.

4. The flat compass according to claim 1 wherein said shank is limited to extend between 0.01 and 1.00 inches into said essentially flat surface.

5. The flat compass according to claim 1 wherein said enlarged flange is a block that both secures said elongated shank to said essentially elongated beam and elevates said elongated shank.

6. The flat compass according to claim 1 wherein said shank is retained in said anchor to prevent said shank from being removed from said anchor.

7. The flat compass according to claim 1 wherein said markings on said essentially flat beam are inch increments.

8. The flat compass according to claim 7 wherein said inch markings repeat every 12 inches.

9. The flat compass according to claim 7 wherein one side of said essentially flat beam has incrementally increasing inch increments and the opposing side of said essentially flat beam has markings that repeat every 12 inches.

10. The flat compass according to claim 1 wherein said markings on said essentially flat beam are in metric distance increments.

11. The flat compass according to claim 1 wherein said essentially flat beam is configured with a step that provides a means for engaging a second, or subsequent essentially, flat beams to said beam to increase the length of the beam to draw larger arcs.

12. The flat compass according to claim 11 wherein each second, or subsequent, essentially flat beams have mating notches on opposing ends of said beams.

13. The flat compass according to claim 1 wherein said head further includes an indicating means to identify the dimension of the arc that will be marked with said marking means.

14. The flat compass according to claim 1 wherein said tracking means is a rotatable wheel.

15. The flat compass according to claim 14 wherein said rotatable wheel is self-tracking.

16. The flat compass according to claim 14 wherein said rotatable wheel is adjustable for height between a contact surface of said rotatable wheel and said essentially flat beam.

17. The flat compass according to claim 1 wherein said marking means is a pencil, pen, marker, cutter or scribe.

18. The flat compass according to claim 1 wherein said marking means is adjustable for height between a marking tip and said essentially flat beam.

19. The flat compass according to claim 1 said head allows said tracking means and said marking means to be independently or dependently adjustable for their height between a contact surfaces and said essentially flat beam.

* * * * *